US008042935B2

(12) United States Patent
Hart

(10) Patent No.: US 8,042,935 B2
(45) Date of Patent: Oct. 25, 2011

(54) MICRO-MINIATURE FLUID JETTING DEVICE

(75) Inventor: Brian Christopher Hart, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/647,602

(22) Filed: Dec. 28, 2009

(65) Prior Publication Data

US 2010/0118070 A1 May 13, 2010

Related U.S. Application Data

(62) Division of application No. 11/378,951, filed on Mar. 17, 2006, now Pat. No. 7,673,988.

(51) Int. Cl.
*B41J 3/36* (2006.01)
*B41J 2/175* (2006.01)

(52) U.S. Cl. ..... 347/109; 347/86

(58) Field of Classification Search ..... 347/109, 347/86

See application file for complete search history.

(56) References Cited

U.S. PATENT DOCUMENTS 6,832,824 B1 * 12/2004 Baker et al. ..... 347/19
7,090,345 B2 * 8/2006 Pierce ..... 347/108
2009/0058966 A1 * 3/2009 Silverbrook et al. ..... 347/86

FOREIGN PATENT DOCUMENTS

JP 2005178386 A * 7/2005

* cited by examiner

*Primary Examiner* — Stephen Meier
*Assistant Examiner* — Sarah Al Hashimi

(57) ABSTRACT

Micro-fluid jetting devices and methods for ejecting fluid mixtures on a substrate are disclosed. Embodiments of the invention show fluid-flow architecture whereby fluid channels direct a plurality of fluids from their respective reservoirs to be ejected through the nozzles of a nozzle plate.

3 Claims, 16 Drawing Sheets

MICRO-MINIATURE FLUID JETTING DEVICE

CROSS REFERENCE TO RELATED APPLICATIONS

This is a divisional application of U.S. patent application Ser. No. 11/378,951 filed Mar. 17, 2006 now U.S. Pat. No. 7,673,988, entitled "MICRO-MINIATURE FLUID EJECTION DEVICE."

TECHNICAL FIELD

The invention relates to micro-fluid jetting devices and in particular to multi-fluid, handheld jetting devices having improved fluid ejection characteristics.

BACKGROUND AND SUMMARY

Micro-fluid jetting devices are suitable for a wide variety of applications including, but not limited to, hand-held ink jet printers, ink jet highlighters, and ink jet air brushes. One of the challenges to providing such micro-fluid jetting devices on a large scale is to provide a manufacturing process that enables high yields of high quality jetting devices. Another challenge is to provide fluid jetting devices, such as handheld painting and printing devices that are capable of precisely reproducing any color at any time without color anomalies, which may include color halos.

The use of handheld ink jet jetting devices for applying single colors to an object such as paper is a relatively simple operation. However, providing a mixture of color inks to an object using a micro-fluid jetting device presents significantly more challenges. For example, conventional handheld ink jet printing devices for printing multiple colors have a substantially linear nozzle arrangement as shown in FIG. 1. Nozzle holes 2 for cyan, 3 for magenta and 4 for yellow are illustrated. When the printhead having the foregoing substantially linear nozzle arrangement is used to produce a single solid color that is a mixture of two or more ink colors, unwanted color areas (hereafter referred to as "halos") are deposited on the substrate as the printing device is moved. For example, when a conventional handheld ink jet printing device is moved in a perfectly linear direction, indicated by arrow 5, across a substrate to provide a composite black bar 6, unwanted cyan 7 and purple 8 halos appear on one side of the black bar 6 and unwanted orange 9 and yellow 11 halos appear on an opposite side of the black bar 6 along the linear direction the ink jet printing device is being moved, if the speed of movement is not perfectly linked to the timing of ink ejection. Additional halos may be formed if the printhead does not move in a perfectly linear direction. In order to produce the black bar 6, the printhead must be moved substantially in the direction indicated by arrow 5. If the printhead is moved perpendicular to the direction indicated by arrow 5, composite colors cannot be printed because nozzle holes 2 for cyan, 3 for magenta, and 4 for yellow do not pass over the same point on the media. Accordingly, there is a need for improved handheld micro-fluid jetting devices that provide more uniform jetting of fluids when moved in a linear direction across a media.

With regard to the foregoing and other objects and advantages exemplary embodiments of the disclosure provide a micro-fluid jetting device and a method of ejecting fluid mixtures onto a substrate. The micro-fluid jetting device includes a housing containing a logic circuit and fluid reservoirs for at least two different fluids. A micro-fluid ejection head is attached to a first end of the housing. The ejection head is in electrical communication with the logic circuit and the fluid reservoirs. At least two channel members are provided for directing fluid from the reservoirs to a plurality of fluid ejection nozzles in a nozzle plate member. The ejection nozzles for each of the at least two different fluids are arranged in the nozzle plate member so that adjacent ejection nozzles are in flow communication with different fluids. A power source in electrical connection with the micro-fluid ejection head is provided in the housing for activating the micro-fluid ejection head for jetting the fluids therefrom.

In another embodiment, the disclosure provides a method for jetting different fluids to provide a mixture of different fluids deposited onto a substrate. The method includes providing a housing containing a logic circuit, fluid reservoirs for at least two different fluids, and a micro-fluid ejection head attached to a first end of the housing. The ejection head is in electrical communication with the logic circuit and the fluid reservoirs. At least two channel members are provided in the ejection head for directing fluid from the reservoirs to a plurality of fluid ejection nozzles in a nozzle plate member. The ejection nozzles for each of the at least two different fluids are arranged in the nozzle plate member so that adjacent ejection nozzles are in flow communication with different fluids. A power source in electrical connection with the micro-fluid ejection head is provided in the housing for activating the micro-fluid ejection head for jetting the fluids therefrom. Upon activation of the micro-fluid ejection head a mixture of fluids is ejected onto the substrate.

An advantage of the exemplary embodiments described herein is that an essentially uniform mixture of fluids may be ejected onto a substrate regardless of the direction the printhead is being moved without causing the halo effect provided by conventional handheld fluid ejection devices.

BRIEF DESCRIPTION OF THE DRAWINGS

Further advantages of the exemplary embodiments may become apparent by reference to the detailed description of preferred embodiments when considered in conjunction with the drawings, wherein like reference characters designate like or similar elements throughout the several drawings as follows.

DETAILED DESCRIPTION OF EXEMPLARY EMBODIMENTS

Figure 3:
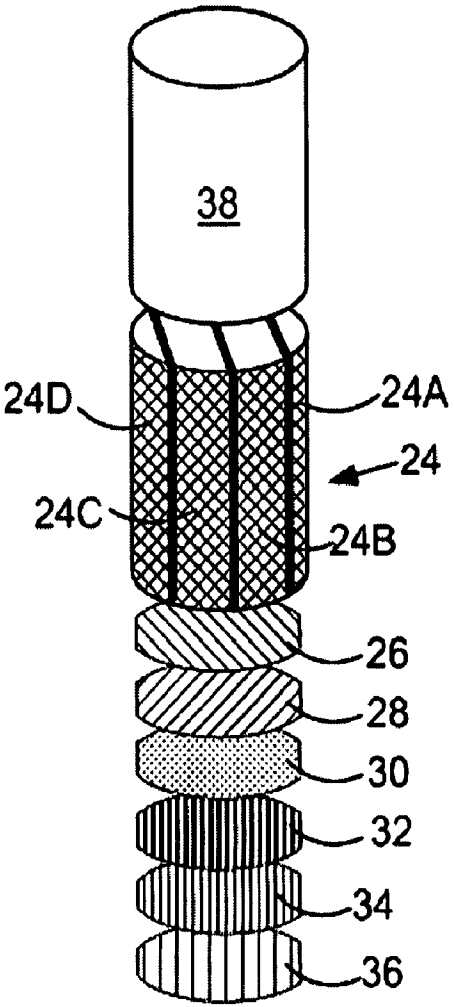
FIG. 3 is a partial exploded view, in perspective, of components of a micro-fluid jetting device according to the disclosure.
Figure 2:
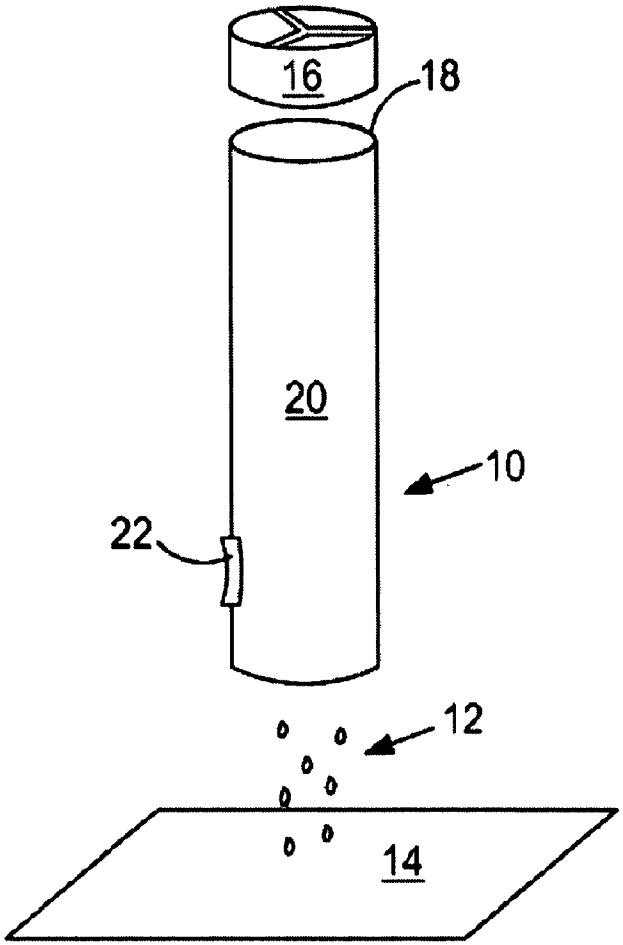
FIG. 2 is a perspective view, not to scale, of a micro-fluid jetting device according to an exemplary embodiment.

With reference to FIGS. 2-3, aspects of embodiments described herein are illustrated. FIG. 2 is a perspective view of a micro-fluid jetting device 10 jetting fluids 12 therefrom onto a substrate 14 such as paper. In the case of the fluids 12 being inks, a color detection device 16, described in more detail below, may be fixedly or removably attached to an opposing end 18 of the device 10. A housing component 20 of the jetting device 10 may include an activation switch 22 for selectively depositing the fluid 12 on the substrate 14.

The housing component 20 of the jetting device 10 may also include fluid ejection controls and/or a display. For jetting of inks, the controls may include line width, line shape, single color (such as an RGB setting) or dual colors (such as a slide switch allowing the user to dynamically adjust between two colors while writing). A color or monochrome LCD panel may be used to display color settings, line width and shape settings, battery level, and any additional information provided by the docking station and/or computer, such as a user-specified program that dynamically changes output ink colors, shapes, and/or line widths. The controls and/or displays may be included in the docking station 130 (FIG. 20) in addition to, or instead of, on the housing component 20 of the jetting device 10.

As illustrated in more detail in FIGS. 3-11, the housing 20 is configured for containing at least two different fluids 12 in separate fluid reservoirs 24. In FIG. 3, the jetting device 10 may include four separate fluid reservoirs 24A, 24B, 24C, and 24D. For example, the fluid reservoirs 24A-24D may contain cyan, magenta, yellow, and black or white inks. Each of the fluids 12 in the reservoirs 24A-24D is directed through a series of channel plates 26-34 to predetermined portions of a nozzle plate 36 for ejection onto the substrate 14. Also included in the housing 20 are a power supply 38 and logic circuit for activating fluid ejector actuators in the device 10.

Each of the fluid reservoirs 24A-24D may have one or more openings for flow of fluid therefrom toward the nozzle plate 36 through the series of channel plates 26-34. In an embodiment wherein the jetting device 10 contains reservoirs 24 for four different fluids, reservoir 24A contains one or more fluid exit ports 40, reservoir 24B contains one or more fluid exit ports 42, reservoir 24C contains one or more fluid exit ports 44 and reservoir 24D contains one or more fluid exit ports 46 as shown in an exit side of the fluid reservoirs 24 in FIG. 4. Each of the exit ports 40-46 provides fluid from the corresponding reservoir 24A-24D to the channel plate 26.

Figure 5:
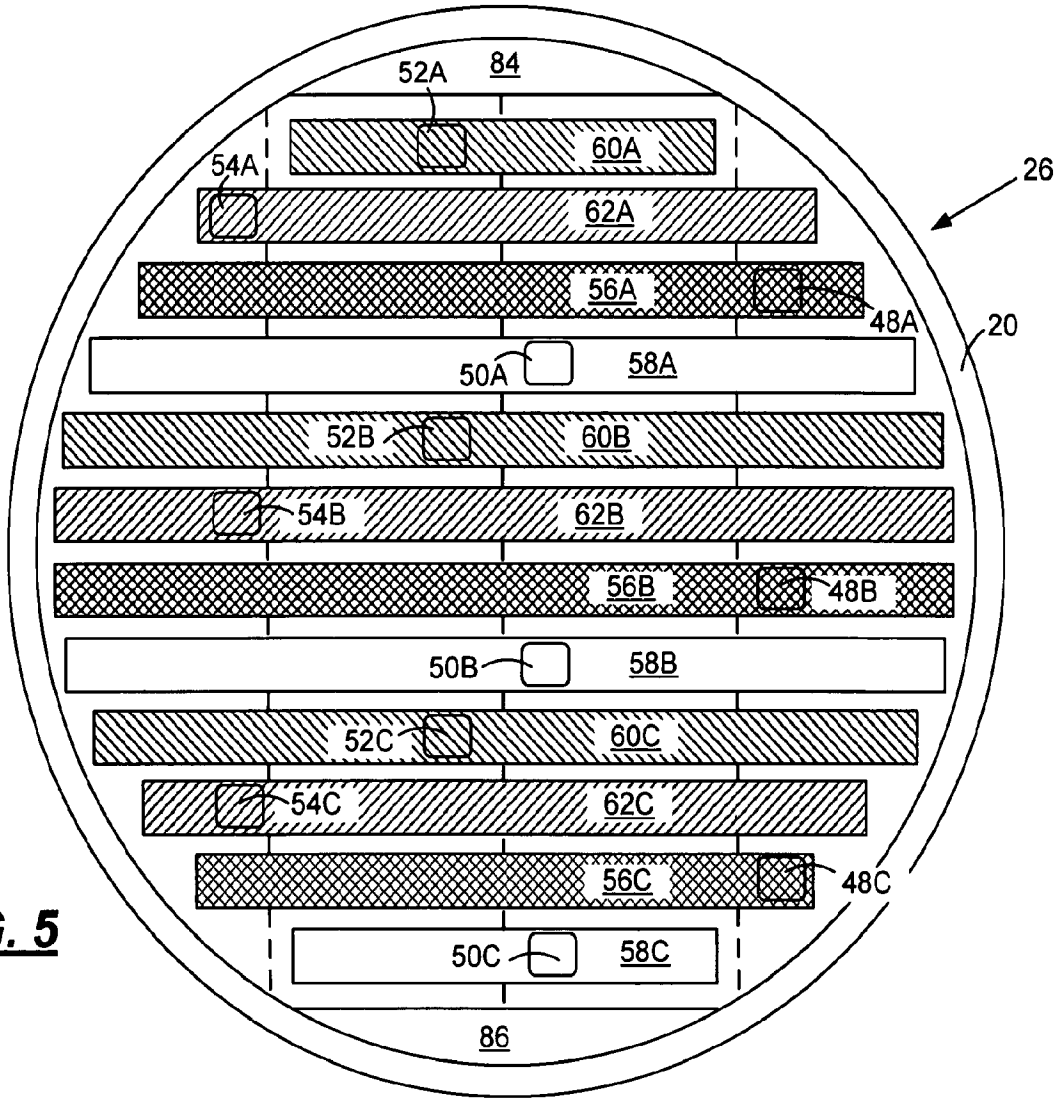
FIGS. 5-9 are plan views, not to scale, of fluid channel plates for a micro-fluid jetting device according to the disclosure.

The channel plate 26, viewed from a side thereof opposite the fluid reservoirs 24A-24D in FIG. 5, contains a plurality of fluid inlet ports and a plurality of flow channels therein for distribution of fluid flowing from the corresponding fluid reservoirs. For example, channel plate 26 includes inlet ports 48A-48C corresponding to exit ports 40 from fluid reservoir 24A, inlet ports 50A-50C corresponding to exit ports 42, inlet ports 52A-52C corresponding to exit ports 44, and inlet ports 54A-54B corresponding to exit ports 46. Each of the inlet ports 48-54 is in fluid flow communication with a corresponding channel 56-62. The channels 56A-56C distribute fluid from reservoir 24A to ejection actuators 63 (FIG. 6) distributed in a predetermined pattern on channel plate 28.

Figure 6:
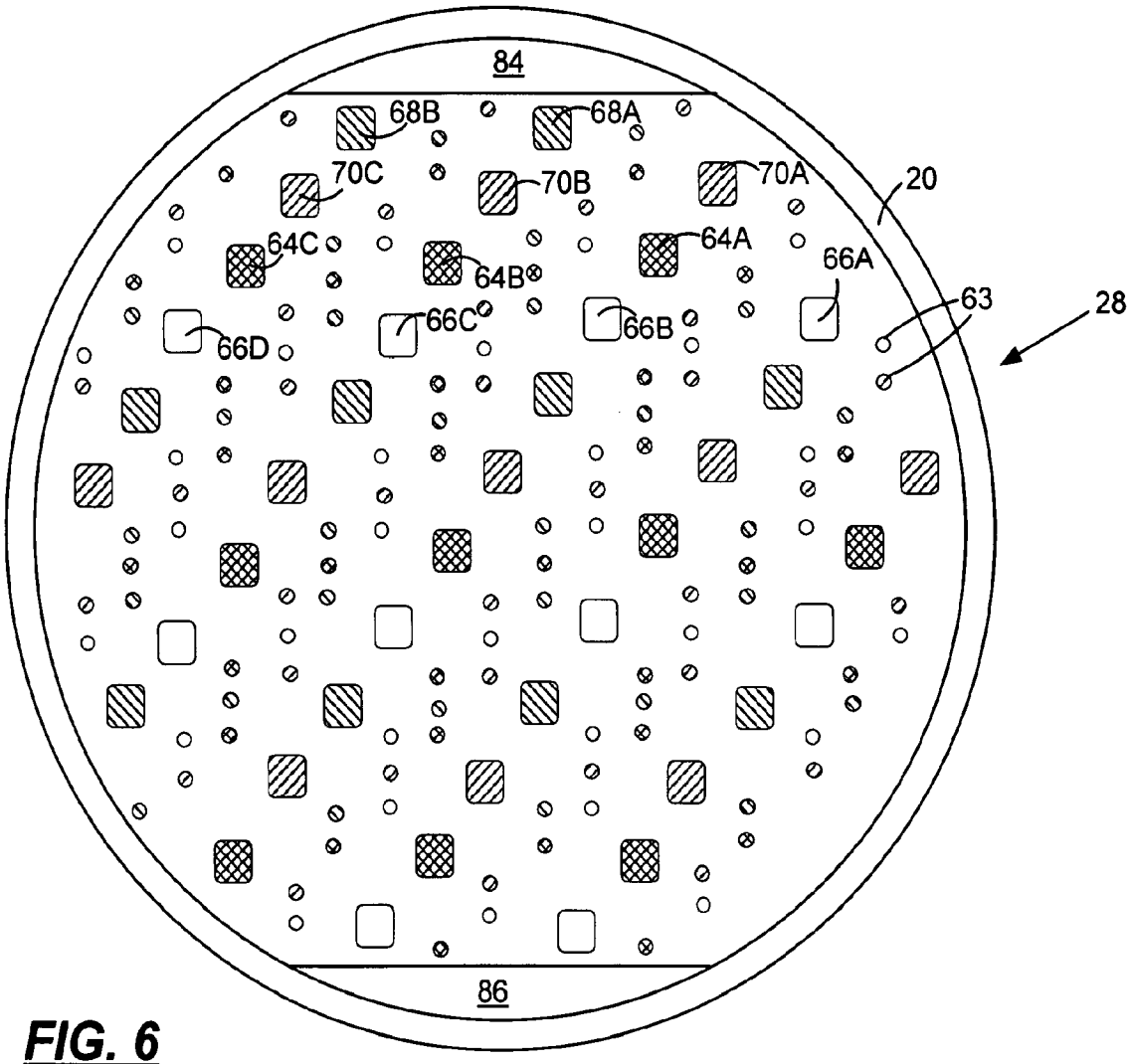
Figure 7:
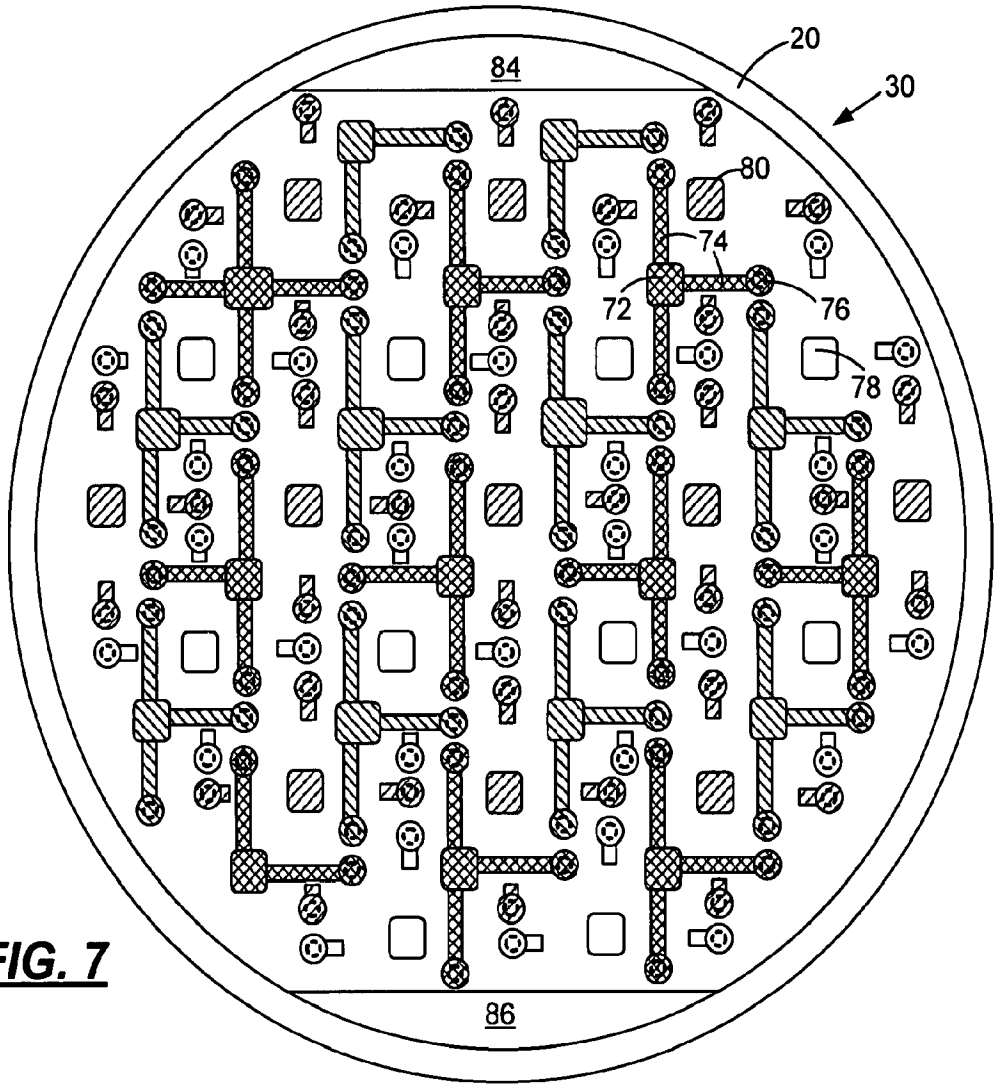
Figure 8:
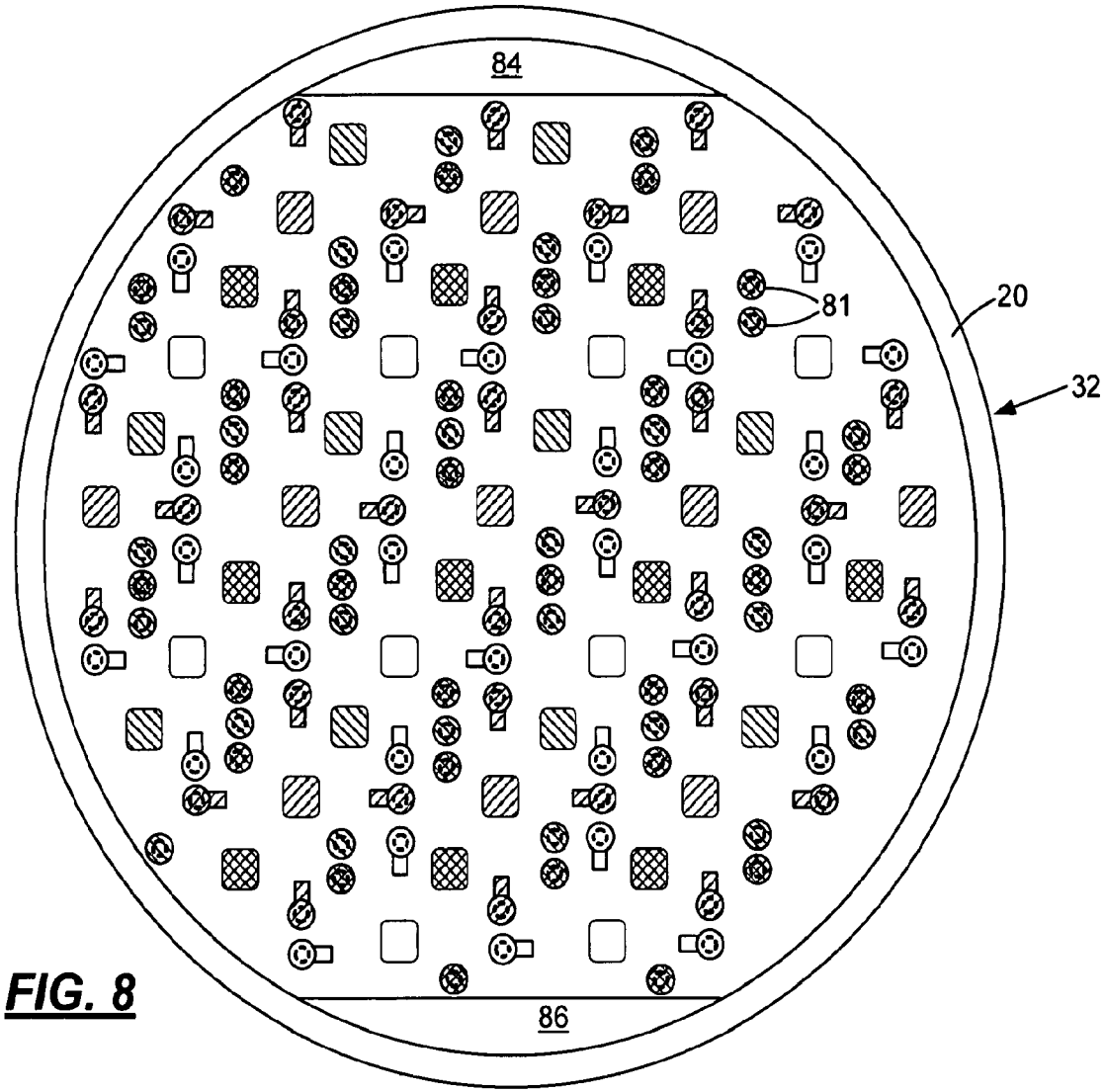

FIG. 6 provides a plan view of fluid vias, such as vias 64-70, in the channel plate 28 for flow of fluid to corresponding fluid ejection actuators 63 for each of the fluids. The fluid vias 64-70 are in fluid flow communication with the channels 56-62 described above. For example, fluid vias 64A-64C are in flow communication with the channel 56A, fluid vias 66A-66D are flow communication with the channel 58A, fluid vias 68A-68B are in flow communication with the channel 60A, and fluid vias 70A-70C are in flow communication with the channel 62A. Accordingly, each of the channels 56-62 provides fluid to at least two of the vias 64-70 in channel plate 28.

Two of the fluids, namely fluids from reservoirs 24A and 24C, are further distributed by channel plate 30 (FIG. 7) for flow into individual fluid channels and fluid chambers for ejection by the fluid actuator devices 63. Fluid vias 64A-64C communicate with fluid openings, such as opening 72 for distribution to flow channels 74 and fluid chamber 76 corresponding to each of the fluid openings for fluids from reservoirs 24A and 24C. The channel plate 28 also contains flow through openings 78 and 80 for flow through channel plate 32 to channel plate 34 for fluids from reservoirs 24B and 24D.

When four or more fluids are provided in the jetting device, a divider channel plate 32 (FIG. 8) may be used between channel plates 30 and 34. The divider channel plate 32 includes flow through openings 81 therein for flow to the channel plate 34 and the nozzle plate 36. For jetting devices 10 containing from one to three fluids, the divider channel plate 32 may be eliminated.

Figure 9:
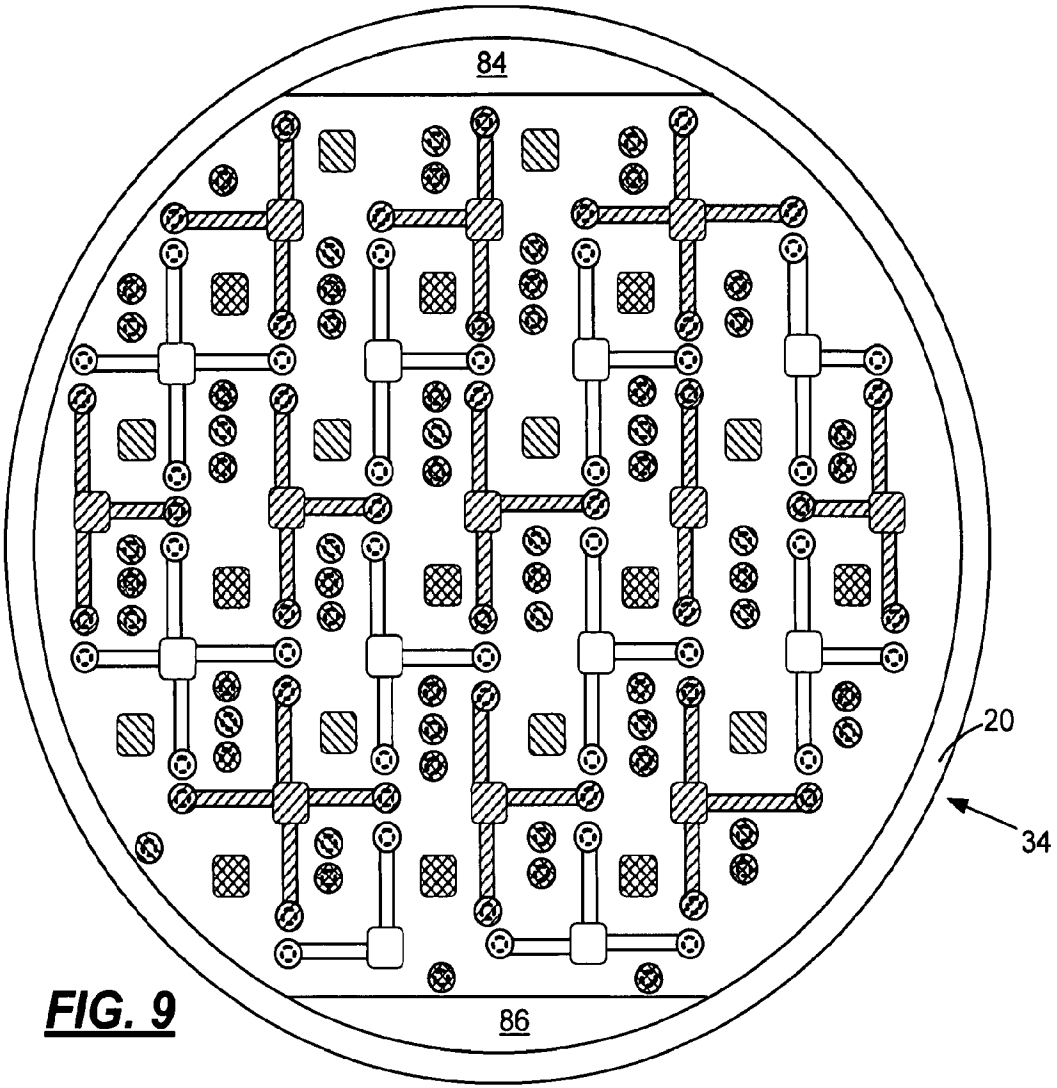

FIG. 9 provides the channel plate 34 having similar features to channel plate 30 (FIG. 6), however, the channel plate 34 is configured for ejection of fluids from the reservoirs 24B and 24D.

Figure 10:
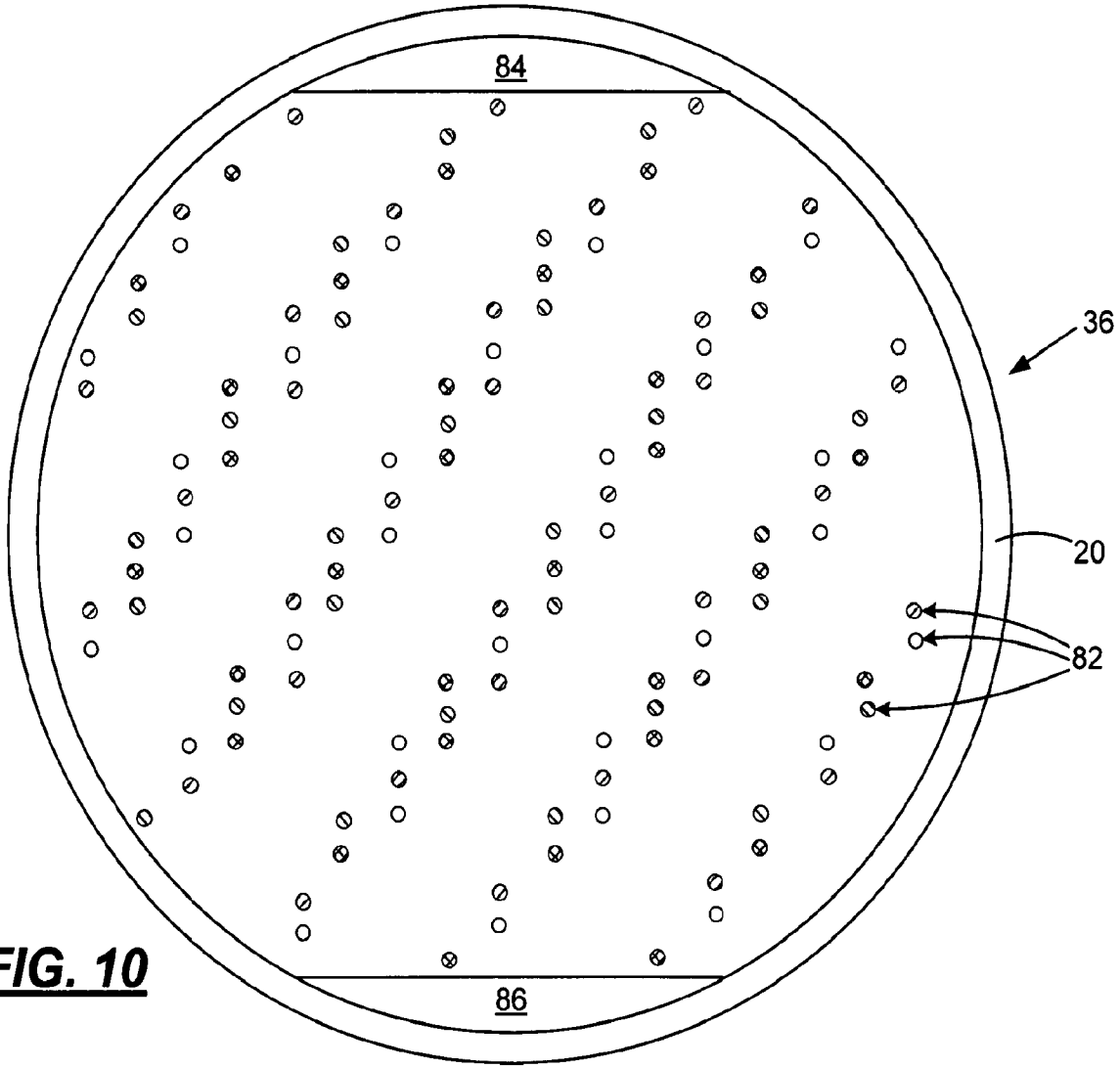
FIG. 10 is a plan view, not to scale, of a nozzle plate for a micro-fluid jetting device according to one exemplary embodiment of the disclosure.

FIG. 10 provides a plan view of the nozzle plate 36 containing nozzle holes 82. The nozzle holes 82 are distributed in a pattern that provides different fluid for closely adjacent nozzle holes 82. Another pattern for nozzle holes 84 may include concentric circular patterns of the nozzle holes for different fluids as shown and described in more detail below.

In FIGS. 4-10, the passage areas 84 and 86 are located between the housing 20 and the channel plates 26-34 and the nozzle plate 36 for electrical wiring or circuit components.

The channel plates 26-34 and the nozzle plate 36 may be made from a wide variety of materials including, but not limited to, polymeric materials, ceramic materials, silicon materials, and the like. A particularly suitable material for the channel plates 26 and 30-34 is a photoimageable material such as a positive or negative photoresist material. For example, photoresist materials that may be spin coated onto or laminated to one another may be used to provide the channel plates 26 and 30-34 and the nozzle plate 36 by a process as described with reference to FIGS. 11-14.

Figure 11:
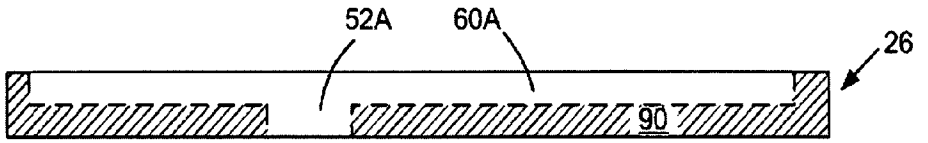
FIGS. 11-14 are schematic views of method for making and assembling channel plates for a micro-fluid jetting device according to the disclosure.
Figure 12:
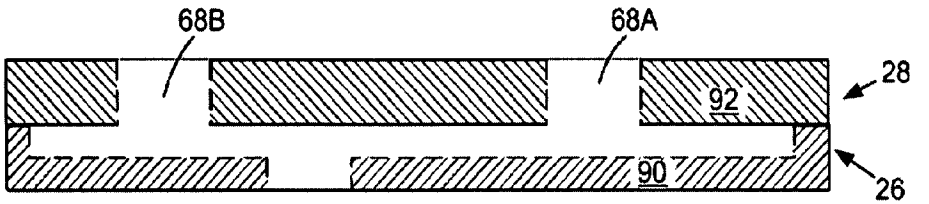

The channel plate 26 may be provided by a first layer 90 that is photoimaged and developed to provide the channel 60A and the inlet port 52A shown in outline in FIG. 11. In the alternative, the channel plate 26 may be formed by cutting, wet etching, dry etching or the like, a silicon wafer or other substrate used to form the first layer 90. The channel plate 26 may then be applied, as by a lamination process, to a second layer 92, as shown in FIG. 12, to provide the channel plate 28. The second layer 92 may be made of a substrate material, such as silicon, ceramic, and the like, that may be deep reactive ion etched to provide the fluid vias 68A and 68B prior to laminating the channel plate 26 to the channel plate 28.

Figure 13:
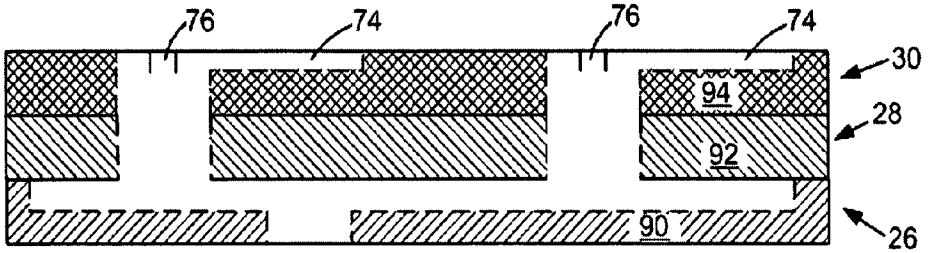

In FIG. 13, a third photoresist layer 94 is applied to the second layer 92, as by a lamination process. Layer 94 is imaged to provide the flow channels 74 and the fluid chambers 76 for providing channel plate 30. The layer 92 may be developed after imaging, or may be developed after imaging subsequent channel plates that are applied to the channel plates 26-30.

Figure 14:
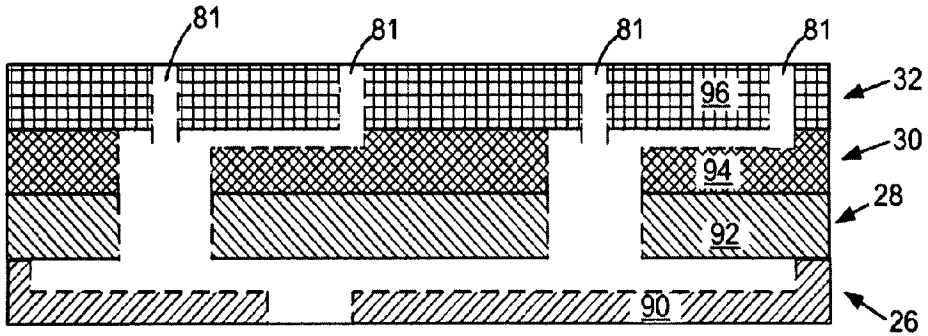

FIG. 14 illustrates the application of a layer 96 to the layer 94 to provide the divider channel plate 32 having the flow through openings 81 imaged therein. If the channel plate 30 is not developed before layer 96 is applied to layer 94, then layer 96 may be spin coated onto layer 94. Subsequently, the channel plate 34 may be spin coated and imaged as described above.

Once all of the channel plates 32-34 have been imaged, they may be developed all at one by exposing the imaged channel plates 32-34 to a conventional developing fluid. In the alternative, for laminated layers 94-96, each layer may be developed before a subsequent layer is laminated thereto. For example, in the case of the channel plates 26 and 30-34 being made of a polyimide or other polymeric material, each of the layers 90 and 94-96 may be laser ablated to provide the channels and flow features described above before subsequent layers are laminated thereto. Likewise, in the case of any of the channel plates 26-34 being made of silicon, ceramic, or composite materials, each layer may be dry etched, wet etched, mechanically machined, or laser cut before a subsequent layer is attached thereto.

Depending on the number of different fluids in the fluid reservoirs of the jetting device, more or fewer channel plates may be used to provide selective flow of fluids to the nozzle plate 36. For example, a jetting device for jetting two different fluid may only contain the channel plates 26-30 and the nozzle plate 36. Also, both sides of one or more of the channel plates 26-34 may be imaged and developed to provide the various channels rather than providing individual channel plates 26-34 as shown.

The nozzle plate 36 may be made of an electroformed metal or may be formed from a ceramic, composite, or silicon material. The nozzle plate 36 may likewise be made of a photoimageable material such as a positive or negative photoresist, or may be made of a polyimide or other polymeric material. In the case of a photoresist material, the nozzle plate 36 may be spin coated as a layer onto the layer 96 and imaged and developed as described above with reference to the layers 90-96 to provide the nozzle holes 82. When the nozzle plate 36 is made of a polyimide or other polymeric material, the nozzle holes 82 may be laser ablated or molded into the nozzle plate material.

Layers 90, 92, 94, and 96 may be attached to one another and/or the housing component 20 and fluid reservoirs 24 using adhesives, laser welding, ultrasonic welding, solvent welding, thermal compression bonding, lamination, heat staking, or other conventional methods.

The ejector actuators 63 for the fluids may be provided by thermal ejection actuators, piezoelectric actuators, electromagnetic actuators, and the like. A typical thermal type fluid ejection actuator is provided by multiple thin film insulative and conductive materials deposited on the substrate 92. The substrate 92 may be provided by a silicon material containing a thermal barrier layer and a resistive material layer. The resistive layer may be made from a variety of materials including but not limited to tantalum/aluminum alloys. A first metal conductive layer such as aluminum, copper, or gold may provide anode and cathode connections to the resistive layer. In order to protect the ejection actuator from corrosion and erosion, a dual layer including a passivation layer made of silicon nitride, silicon carbide, or a combination of silicon nitride and silicon carbide, and a cavitation layer made of tantalum may be applied to the material resistive layer. A dielectric layer may be provided over the first metal conductive layer to insulate the first metal conductive layer from a second metal conductive layer. Like the first metal conductive layer, the second metal conductive layer may be made of aluminum, copper, gold and the like.

Figure 15:
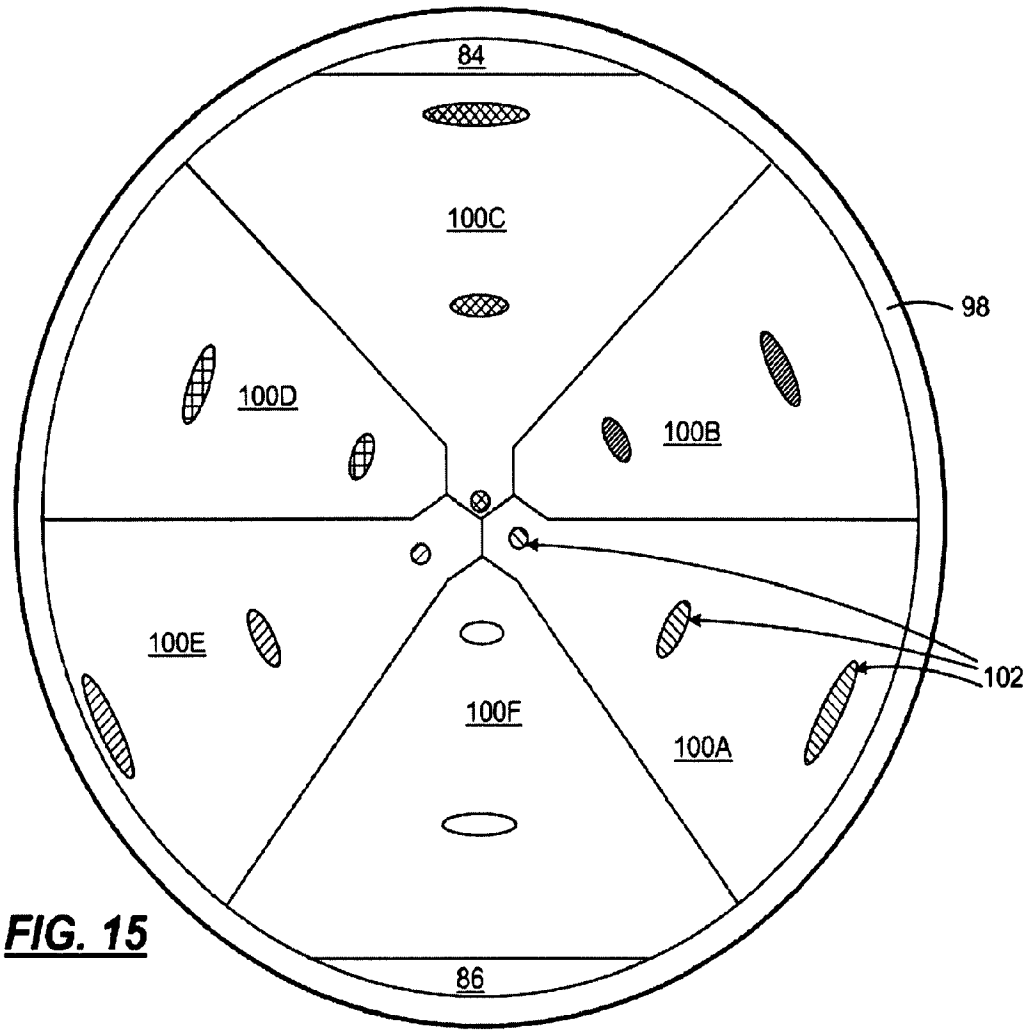
FIG. 15 is a plan view, not to scale, of fluid openings for a fluid reservoir for a micro-fluid jetting device according to a second embodiment of the disclosure wherein the fluid reservoir contains six fluids.

In FIGS. 15-19, an alternate embodiment for channel plates and a nozzle plate is illustrated. Rather than a diagonal arrangement of alternating ejection nozzles for four fluids, the alternate embodiment illustrates a concentric alternating ejection nozzle arrangement. In FIG. 15, a housing component 98 for housing six separate fluid reservoirs 100A-100F is illustrated. Each fluid reservoirs, such as reservoir 100A has a one or more fluid outlet ports, such as outlet ports 102.

Figure 16:
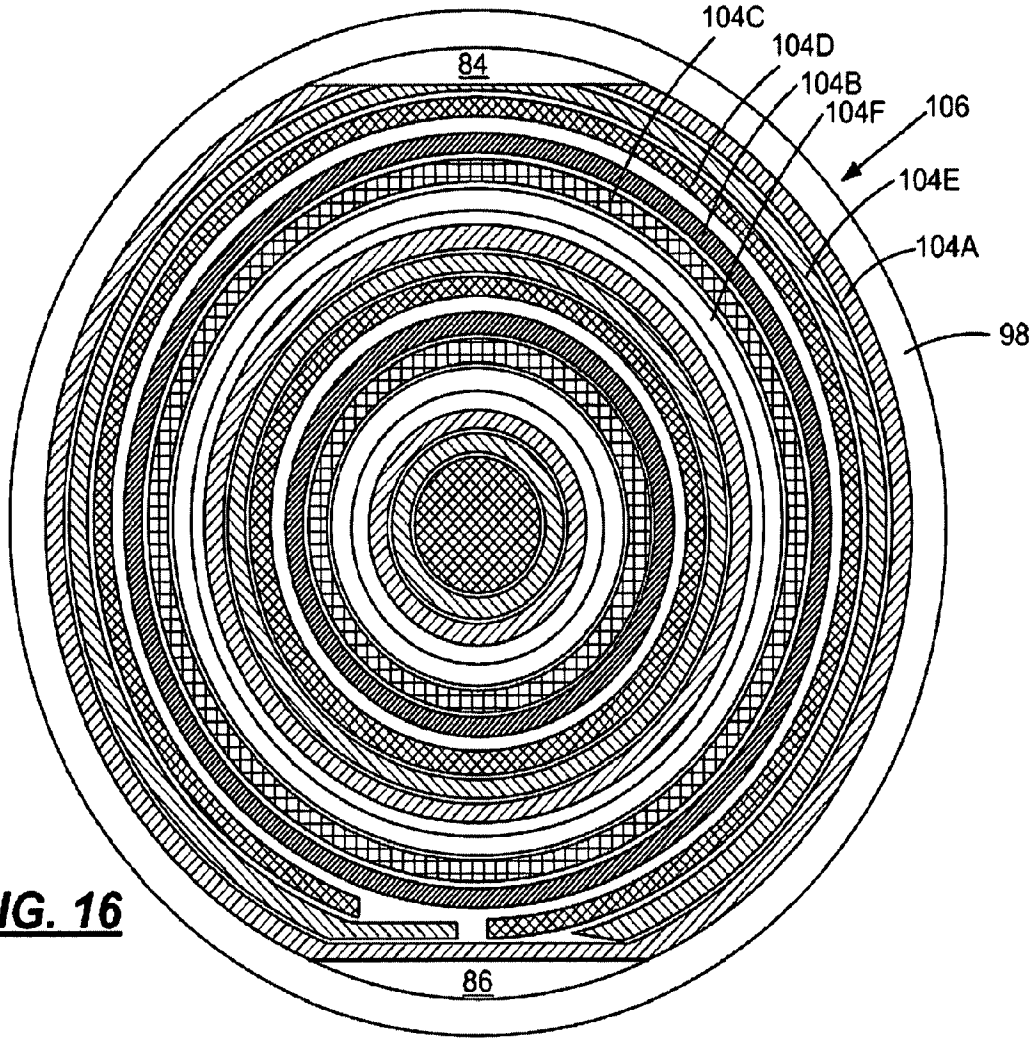
FIGS. 16-18 are plan views, not to scale, of fluid channel plates for a micro-fluid jetting device according to the second embodiment of the disclosure.
Figure 17:
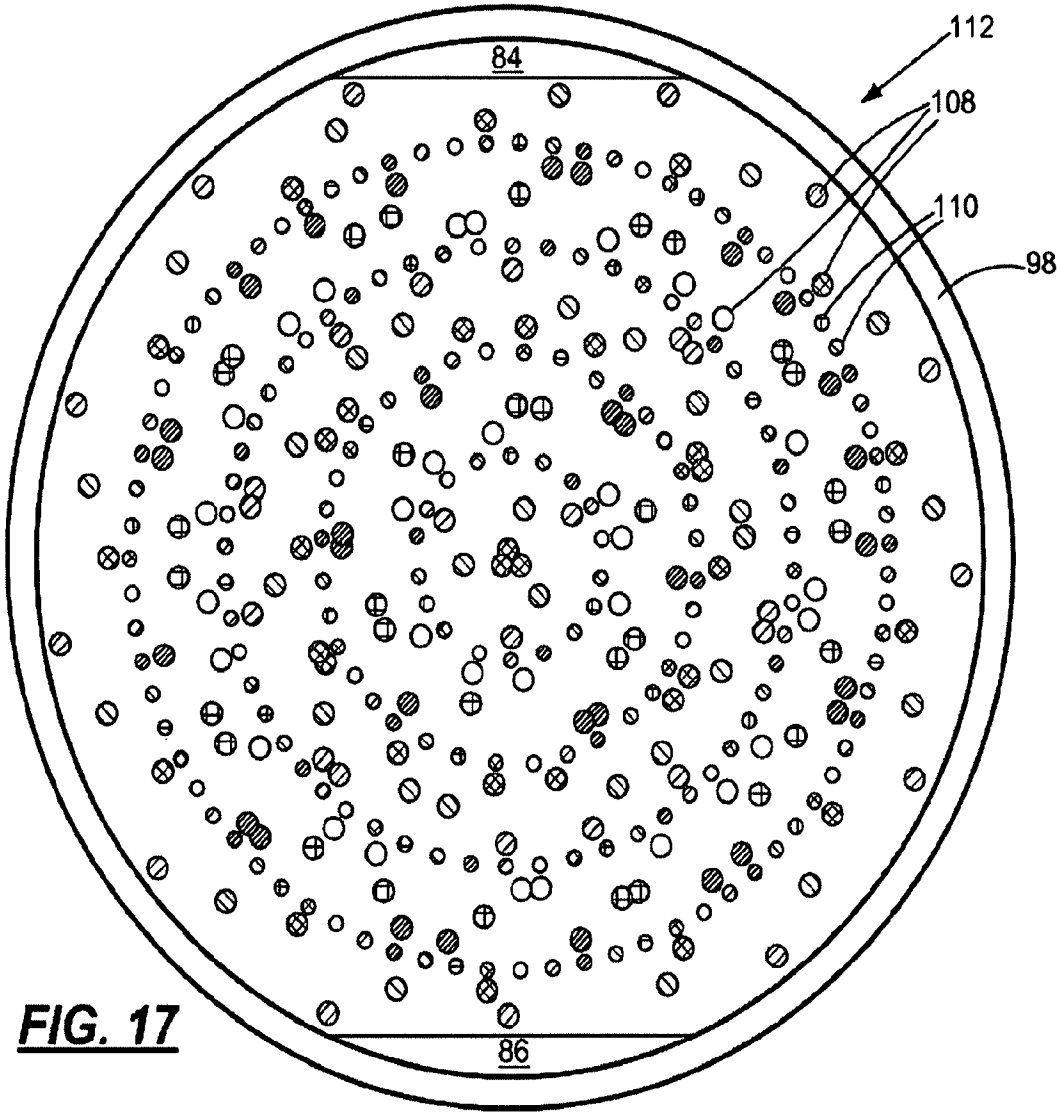
Figure 18:
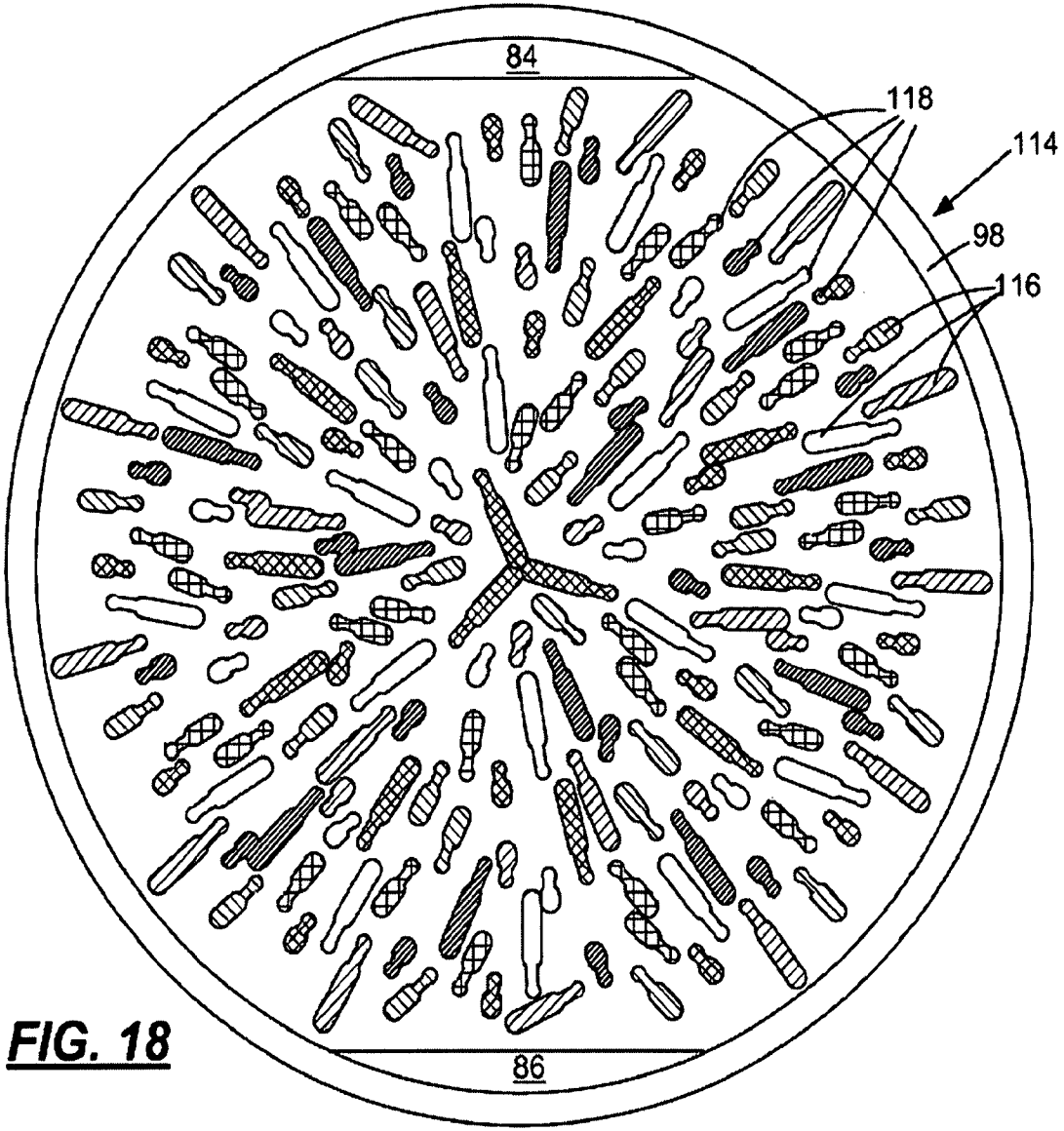
Figure 19:
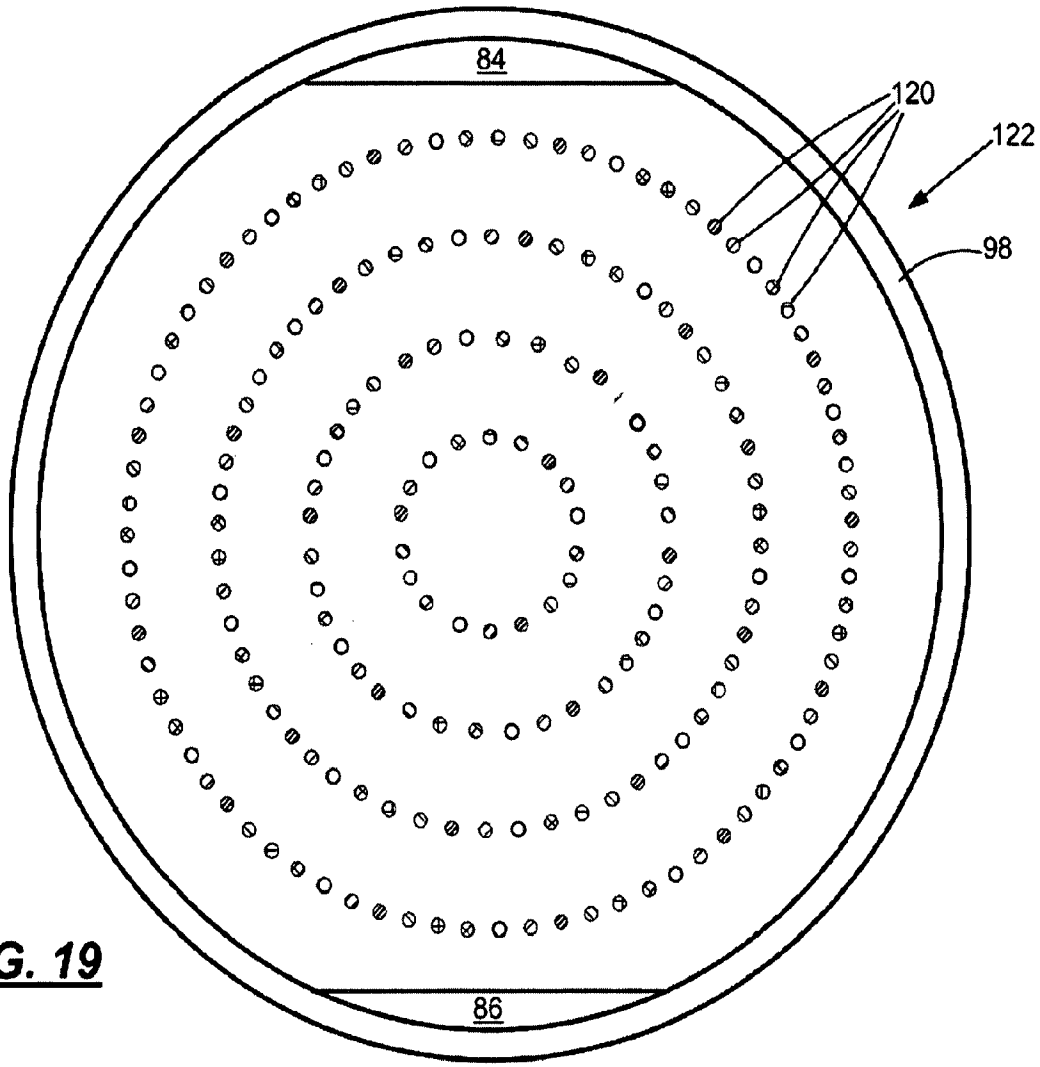
FIG. 19 is a plan view, not to scale, of a nozzle plate for a micro-fluid jetting device according to the second embodiment of the disclosure.

The outlet ports 102 are in fluid flow communication with corresponding concentric flow channels 104A-104F which may be etched into a first side of channel plate 106 as shown in FIG. 16. Corresponding fluid vias 108 for providing fluid to ejection actuators 110 may be etched in a second side of the channel plate 106 or in a separate channel plate 112 (FIG. 17).

Channel plate 114 contains fluid flow channels 116 that are in flow communication with the fluid vias 108 for flow through channels 116 to ejection chambers 118. Upon activation of the fluid ejection actuators, fluid is ejected through nozzle holes 120 in a nozzle plate 122. In other respects, the channel plates 106, 112, and 114 and the nozzle plate 122, may be made and assembled as described above with reference to channel plates 26-34 and nozzle plate 36.

The battery 38, included in the housing component 20, may be a rechargeable battery or a disposable battery. In the alternative, power for the jetting device 10 may be provided by an electrical cable or wire connected to a separate power source.

Figure 20:
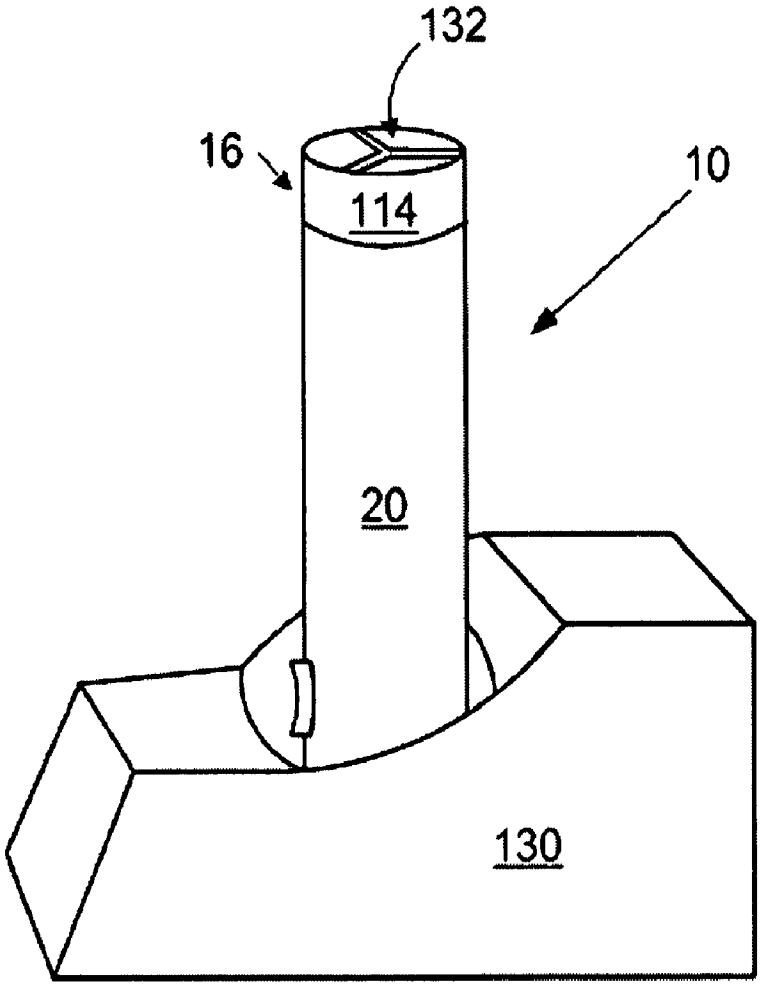
FIG. 20 is a perspective view, not to scale, of a jetting device and a docking station therefore according to one embodiment of the disclosure.

With reference to FIG. 20, an embodiment of the disclosure provides a docking station 130 for the micro-fluid jetting device 10. The docking station 130 may include an ejector head cleaning and maintenance station, a battery charger, in the case of a rechargeable battery as the power source 38, fluid selection and ejector width shape and control devices that are not included on the jetting device, and input and output connections that may interface with a personal computer system for programming memory in the micro-fluid jetting device 10. Another optional feature that may be included with the docking station 130, may include, but is not limited to, a scanner for input of information to the jetting device 10 or the personal computer.

Figure 1:
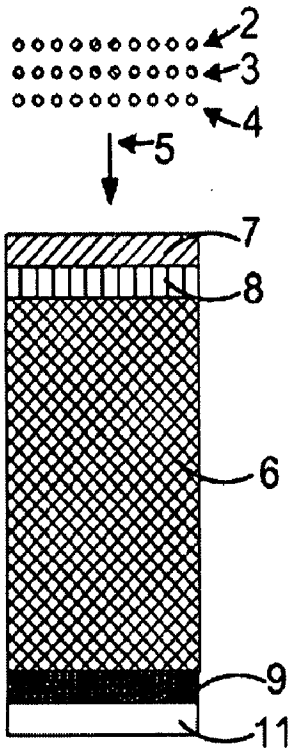
FIG. 1 PRIOR ART
FIG. 1 is a schematic view of a prior art nozzle plate arrangement for an ink jet printhead and a resulting image having unwanted halos.
Figure 4:
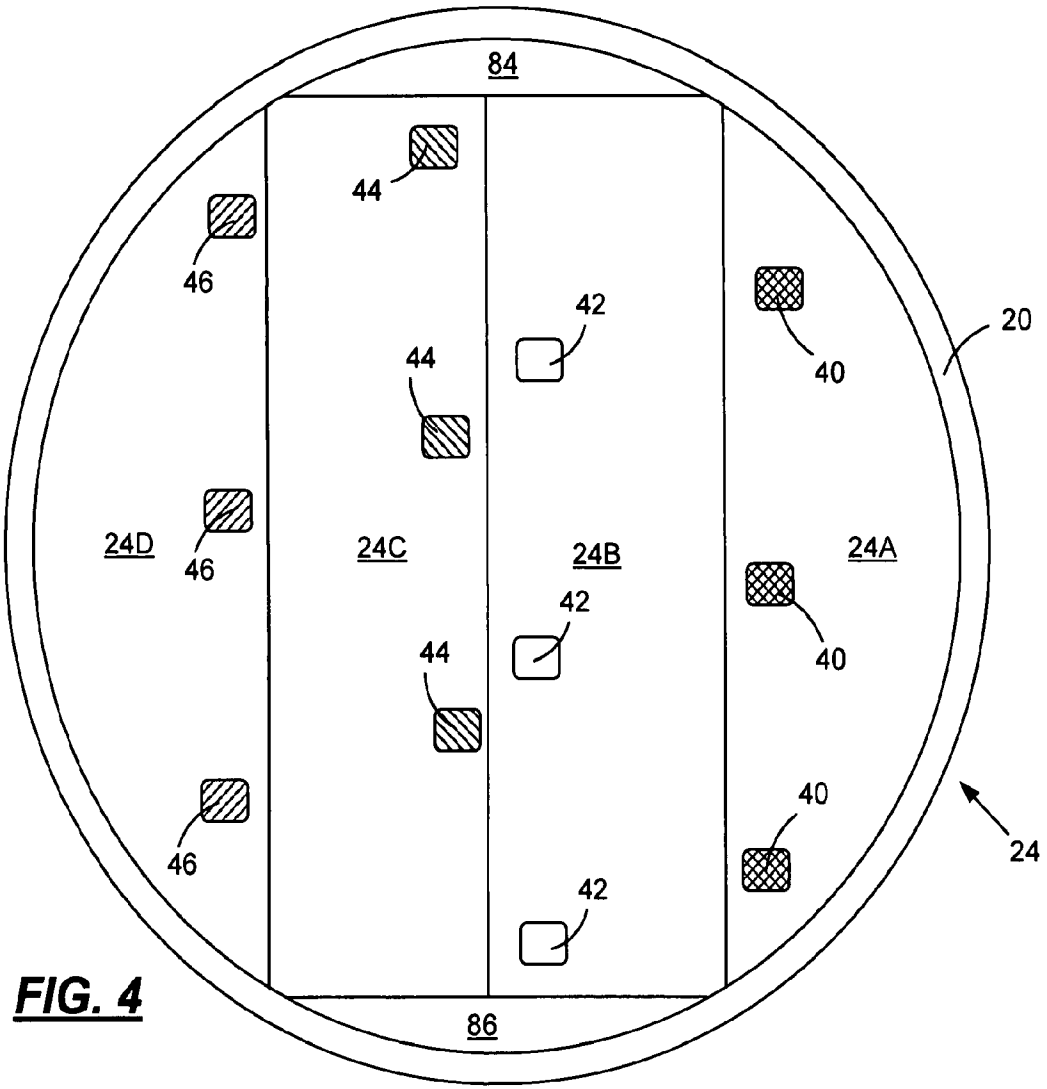
FIG. 4 is a plan view, not to scale, of fluid openings for a fluid reservoir for a micro-fluid jetting device according to a first embodiment of the disclosure wherein the fluid reservoir contains four fluids.

In embodiments wherein the jetting device 10 ejects inks, the jetting device 10 may also include the color detection deice 16 as shown in FIGS. 1 and 20. The color detection device 16 may be removably attached to the jetting device 10 for inputting colors to the jetting device 10. Color detection devices 16 containing a three-element color sensor 132 such as a color sensor available from Laser Components Instrument Group, Inc. of Wilmington, Mass. under the trade name MCS3AT/BT. Such a color sensor 132 includes three Si-PIN photo diodes integrated on a chip. The photo diodes are provided as segments of a ring with a diameter of about 2 millimeters. A phototransistor is located near a red LED, a green LED, and a blue LED so that light reflected from each LED will strike the phototransistor. The LEDs are controlled by LED drivers in a digital ASIC. The phototransistor is connected to an analog to digital converter (ADC) in the digital ASIC. The phototransistor and LED's are mounted in an optical housing 114 so that the LED's in the sensor 132 will be at the proper operating distance when the housing 114 is pressed against a surface. The housing 114 is configured to block ambient light when the sensor 132 is pressed against a surface.

The detection device 16 may be fixedly or removably attached to the end 18 of the housing 20 opposite the nozzle plate 36. The color detection device 16 is operatively connected to a logic circuit to sample a color from a sample color source and provide an output for control of the jetting device 10 to provide ejection of ink therefrom corresponding to the sample color source. The color detection device 16 may be activated with a separate activation switch such as a plunger type switch integral with the color detection device 16.

Figure 21:
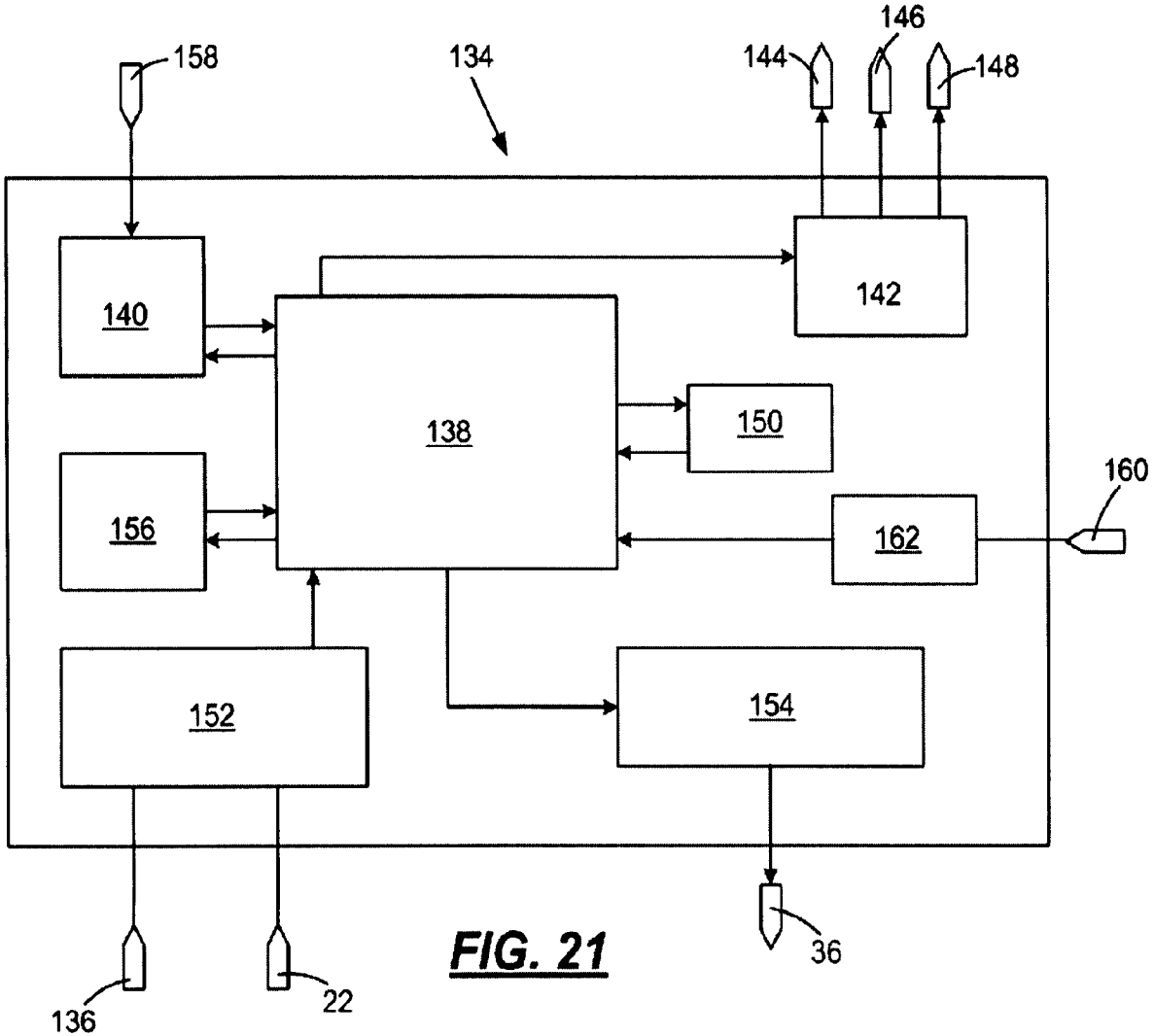
FIG. 21 is a schematic drawing of a control circuit for operation of a micro-fluid jetting device according to the disclosure.

A schematic illustration of a control system 134 for the color detector device 16 is illustrated in FIG. 21. According to the control system 134, a sample switch such as a switch 136 may be located in the housing 114 in such a position that the switch 136 is depressed when the housing 114 is pressed against a surface. A state machine 138 controls the ADC 140 and an LED driver 142 for the LED's 144, 146, and 148, as well as an internal flash memory 150 comprising non-volatile RAM, a switch interface 152, and an ejector head interface 154. The state machine 138 may also be controlled externally through a manufacturing control interface 156.

In operation, a user presses the optical housing 114 against a surface to trigger color sampling. The surface may be a color palette containing sample color sources of different colors, or any colored object the user wishes to duplicate the color thereof. As the sample switch 136 is depressed, the switch 136 signals the state machine 138 to begin the sample process. Each LED 144-148 is turned on individually by the LED driver 142, and a phototransistor 158 ADC reading provided by ADC 140 is stored by the state machine 138 in the non-volatile flash memory 150. Thus, an RGB value is generated and stored in the flash memory 150 for later use.

When the activation switch 22 is depressed by the user, the micro-fluid jetting device 10 will eject ink 12 through the nozzle plate 36 or 122, toward the substrate 14, as shown in FIG. 1, corresponding to the stored RGB value. As the button 22 is pushed, the state machine 138 loads the previously stored RGB value from flash memory 150, and uses the RGB value as an index for input into a three-dimensional lookup table also stored in flash memory 150. The lookup table contains CMY (or CMYK, CMYW, CcMmY, etc., depending on the ink colors available in the fluid reservoirs 24 or 100) values for output to the ejector head interface 154 for selective operation of ejection actuators.

The manufacturing control interface 156 is used during manufacturing to calibrate the color sensor 132. A manufacturing computer can turn on each LED 144-148, read the ADC 140, and write to the flash memory 150, all through the manufacturing control interface 156. Various calibration colors may be sampled by the color sensor 132, and the resulting RGB values are used by the manufacturing computer to generate a custom lookup table for the sensor 132. The lookup table may be stored in the flash memory 150.

In an alternative embodiment, one or more sensors 160 may be included on the jetting device 10 to detect media proximity, speed and direction of pen movement, and type of substrate 14. The sensors 160 may have ADC signals input through a sensor interface 162 to the state machine 138. In another embodiment, the sensors 160 may include a media detection sensor that disables the jetting device 10 from writing on surfaces other than a specified surface, such as white paper, to prevent unwanted ejection of fluids or inks onto fabrics, persons, or other surfaces.

In a typical operation of a jetting device 10 for jetting different color inks, a first mixture of inks to provide a first color may be jetted. The jetting device 10 may then be inserted in the docking station 130 so that the nozzle plate 36 or 122 is wiped to remove any residual amount of the first color so that a second mixture of inks providing a second color may be jetted. In order to provide a desirable color ejected from the jetting device, typically only one color mixture is jetted at a time. However, control schemes may be devise for gradual dynamic color change during a jetting operating.

Droplets 12 ejected from the jetting device 10 may have a size of from about 100 picoliters (pL) or less. In the case of ink droplets, mixing of colors on the media 14 or nozzle plate 36 or 122 may provide a wide variety of color variations. Ink droplets, about 2 pL or less in volume may be ejected from the nozzle holes 82 or 120 so that individual droplets are small enough to be imperceptible by the naked eye without substantial mixing of inks.

It is contemplated, and will be apparent to those skilled in the art from the preceding description and the accompanying drawings, that modifications and changes may be made to the exemplary embodiments disclosed herein. Accordingly, it is expressly intended that the foregoing description and the accompanying drawings are illustrative of preferred embodiments only, not limiting thereto, and that the true spirit and scope of the disclosure be determined by reference to the appended claims.

The invention claimed is:

1. A wireless micro-fluid jetting device configured for ejecting a plurality of fluids, the wireless micro-fluid jetting device comprising:

a handheld housing containing a logic circuit and fluid reservoirs for at least two different fluids, the handheld housing being substantially cylindrical extending from a first end to a second opposite end that a user grasps an exterior thereof to manipulate past a substrate during use;

a micro-fluid ejection head at the first end of the handheld housing to face the substrate during use to eject fluid downward onto the substrate, the ejection head being in electrical communication with the logic circuit and each of the fluid reservoirs;

a self-contained power source in the handheld housing in electrical connection with the micro-fluid ejection head for activating the micro-fluid ejection head for jetting the fluids therefrom; and a color detection device disposed at the second opposite end of the handheld housing, that detects a desired color for use upon activation and samples color of ejected fluid on the substrate upon the user flipping the handheld housing to face the second opposite end to the substrate, wherein the jetted fluid corresponds to the desired color.

2. The wireless micro-fluid jetting device according to claim 1, wherein the color detection device comprises:

a color detector for selecting a desired color, the color detector includes at least one light emitting diode and a phototransistor proximal to the at least one light emitting diode;

a switch that activates color sampling by the color detector upon the user pressing the color detection device against a surface;

a memory; and an analog-digital convertor in electrical communication with the color detector and the memory, the analog digital convertor providing a digital signal corresponding to the desired for storing in the memory.

3. A method for jetting different fluids to provide a mixture of different fluids corresponding to a desired color onto a substrate, the method comprising the:

selecting a color from a sample of colors on a color detection device;

storing a digital reading corresponding to the selected color in the color detection device;

ejecting fluids through a micro-fluid jetting device corresponding to the digital reading stored in the color detection device, the ejecting fluids occurring from a first end of a cylindrical handheld housing;

reorienting the cylindrical handheld housing to face a second opposite end of the housing toward the substrate such that the color detection device faces the substrate while the micro-fluid jetting device faces upward away from the substrate; and pressing the color detection device against a surface to active color sampling of ejected fluid on the substrate.

* * * * *